US010533243B2

(12) United States Patent
Newman et al.

(10) Patent No.: US 10,533,243 B2
(45) Date of Patent: Jan. 14, 2020

(54) 6XXX ALUMINUM ALLOYS, AND METHODS OF MAKING THE SAME

(71) Applicant: ARCONIC INC., Pittsburgh, PA (US)

(72) Inventors: John M. Newman, Export, PA (US); Timothy A. Hosch, Plum, PA (US); John F. Butler, Jr., Lilitz, PA (US)

(73) Assignee: ARCONIC INC., Pittsburgh, PA (US)

( * ) Notice: Subject to any disclaimer, the term of this patent is extended or adjusted under 35 U.S.C. 154(b) by 186 days.

(21) Appl. No.: 15/398,589

(22) Filed: Jan. 4, 2017

(65) Prior Publication Data

US 2017/0198376 A1 Jul. 13, 2017

Related U.S. Application Data

(60) Provisional application No. 62/276,648, filed on Jan. 8, 2016.

(51) Int. Cl.

| | |
|---|---|
| ***C22F 1/043*** | (2006.01) |
| ***C22C 21/02*** | (2006.01) |
| ***B21B 3/00*** | (2006.01) |
| ***B22D 11/00*** | (2006.01) |
| ***B22D 21/00*** | (2006.01) |

(52) U.S. Cl.

CPC ..... *C22F 1/043* (2013.01); *B21B 3/00* (2013.01); *B22D 11/003* (2013.01); *B22D 21/007* (2013.01); *C22C 21/02* (2013.01); *B21B 2003/001* (2013.01)

(58) Field of Classification Search

CPC ..... C22C 21/02; C22F 1/043; B21B 3/00; B22D 11/003; B22D 21/007

USPC ..... 148/437–440; 420/534–535

See application file for complete search history.

(56) References Cited

U.S. PATENT DOCUMENTS

| | | | | |
|---|---|---|---|---|
| 4,174,232 | A | 11/1979 | Lenz et al. | 148/2 |
| 4,808,247 | A | 2/1989 | Komatsubara et al. | |
| 5,496,423 | A | 3/1996 | Wyatt-Mair et al. | 148/551 |
| 5,525,169 | A | 6/1996 | Murtha | 148/695 |
| 5,582,660 | A | 12/1996 | Erickson et al. | 148/688 |
| 5,616,189 | A | 4/1997 | Jin et al. | |
| 5,944,923 | A | 8/1999 | Hayashi et al. | |
| 6,267,922 | B1 | 7/2001 | Bull et al. | 420/534 |
| 6,280,543 | B1 | 8/2001 | Zonker et al. | |

(Continued)

FOREIGN PATENT DOCUMENTS

| | | |
|---|---|---|
| AU | 2014200219 | 1/2014 |
| JP | H11-310841 A | 11/1999 |

(Continued)

OTHER PUBLICATIONS

International Search Report and Written Opinion, dated Apr. 7, 2017, from corresponding International Patent Application No. PCT/US2016/069495.

*Primary Examiner* — Brian D Walck

(74) *Attorney, Agent, or Firm* — Greenberg Traurig, LLP

(57) ABSTRACT

New 6xxx aluminum alloys having an improved combination of properties are disclosed. Generally, the new 6xxx aluminum alloys contain 1.00-1.45 wt. % Si, 0.32-0.51 wt. % Mg, wherein a ratio of wt. % Si to wt. % Mg is in the range of from 2.0:1 (Si:Mg) to 4.5:1 (Si:Mg), 0.12-0.44 wt. % Cu, 0.08-0.19 wt. % Fe, 0.02-0.30 wt. % Mn, 0.01-0.06 wt. % Cr, 0.01-0.14 wt. % Ti, and ≤0.25 wt. % Zn, the balance being aluminum and impurities, wherein the aluminum alloy includes ≤0.05 wt. % of any one impurity, and wherein the aluminum alloy includes ≤0.15 in total of all impurities.

13 Claims, 2 Drawing Sheets

(56) References Cited

U.S. PATENT DOCUMENTS

| | | | | |
|---|---|---|---|---|
| 6,334,916 | B1 | 1/2002 | Matsumoto et al. | |
| 6,464,805 | B2 | 10/2002 | Matsuda et al. | |
| 6,672,368 | B2 | 1/2004 | Unal | 164/480 |
| 6,880,617 | B2 | 4/2005 | Wyatt-Mair et al. | 164/479 |
| 8,273,196 | B2 | 9/2012 | Hibino et al. | 148/695 |
| 8,328,963 | B2 | 12/2012 | Takaki et al. | 148/417 |
| 8,940,406 | B2 | 1/2015 | Timm et al. | |
| 9,085,328 | B2 | 7/2015 | Bassi et al. | |
| 9,453,273 | B2 | 9/2016 | Matsumoto et al. | |
| 9,932,658 | B2 | 4/2018 | Shishido et al. | |
| 9,938,612 | B2 | 4/2018 | De Smet | |
| 2004/0011438 | A1 | 1/2004 | Lorentzen | |
| 2004/0079457 | A1 | 4/2004 | Kimura et al. | 148/693 |
| 2004/0094249 | A1 | 5/2004 | Uchida et al. | |
| 2005/0183801 | A1 | 8/2005 | Unal et al. | |
| 2015/0211350 | A1 | 9/2005 | Unal et al. | |
| 2008/0178973 | A1 | 7/2008 | Uchida et al. | 148/695 |
| 2008/0318081 | A1 | 12/2008 | Steins | 428/640 |
| 2009/0116999 | A1 | 5/2009 | Furu et al. | 420/535 |
| 2010/0247369 | A1 | 9/2010 | Morimoto | 420/535 |
| 2013/0164170 | A1 | 6/2013 | Nakai et al. | |
| 2014/0000768 | A1 | 1/2014 | Sawtell et al. | 148/551 |
| 2014/0190595 | A1 | 7/2014 | Kehl et al. | |
| 2014/0248177 | A1 | 9/2014 | Kamat et al. | 420/534 |
| 2014/0366997 | A1 | 12/2014 | Kamat et al. | |
| 2015/0354044 | A1 | 12/2015 | Shishido et al. | |
| 2016/0168677 | A1 | 6/2016 | Ribes et al. | |
| 2017/0114431 | A1 | 4/2017 | Aruga et al. | |

FOREIGN PATENT DOCUMENTS

| | | | |
|---|---|---|---|
| JP | 2003-089859 | | 3/2003 |
| JP | 2007-009262 | A | 1/2007 |
| JP | 2007-262484 | | 10/2007 |
| JP | 2011-202273 | B | 10/2011 |
| WO | WO96/07768 | A1 | 3/1996 |
| WO | WO03/066927 | | 8/2003 |
| WO | WO2005-080619 | | 9/2005 |
| WO | WO2011/134486 | A1 | 11/2011 |
| WO | WO2013/188668 | | 12/2013 |
| WO | WO2016/193640 | | 12/2016 |

6XXX ALUMINUM ALLOYS, AND METHODS OF MAKING THE SAME

CROSS-REFERENCE TO RELATED APPLICATIONS

This patent application claims benefit of priority of U.S. Provisional Patent Application No. 62/276,648, filed Jan. 8, 2016, entitled "NEW 6XXX ALUMINUM ALLOYS, AND METHODS OF MAKING THE SAME", which is incorporated herein by reference in its entirety.

BACKGROUND

6xxx aluminum alloys are aluminum alloys having silicon and magnesium to produce the precipitate magnesium silicide ($Mg_2Si$). The alloy 6061 has been used in various applications for several decades. However, improving one or more properties of a 6xxx aluminum alloy without degrading other properties is elusive. For automotive applications, a sheet having good formability with high strength (after a typical paint bake thermal treatment) would be desirable.

SUMMARY OF THE INVENTION

Broadly, the present disclosure relates to new 6xxx aluminum alloys having an improved combination of properties, such as an improved combination of strength, formability, and/or corrosion resistance, among others.

Generally, the new 6xxx aluminum alloys have from 1.00 to 1.45 wt. % Si, from 0.32 to 0.51 wt. % Mg, from 0.12 to 0.44 wt. % Cu, from 0.08 to 0.30 wt. % Fe, from 0.02 to 0.09 wt. % Mn, from 0.01 to 0.06 wt. % Cr, from 0.01 to 0.14 wt. % Ti, up to 0.10 wt. % Zn, the balance being aluminum and impurities, where the aluminum alloy includes ≤(not greater than) 0.05 wt. % of any one impurity, and wherein the aluminum alloy includes ≤(not greater than) 0.15 in total of all impurities. As described in further detail below, the new 6xxx aluminum alloys may be continuously cast into a strip, and then rolled to final gauge via one or more rolling stands. The final gauge 6xxx aluminum alloy product may then be solution heat treated and quenched. The quenched 6xxx aluminum alloy product may then be processed to a T4 or T43 temper, after which the product may be provided to an end-user for final processing (e.g., forming and paint baking steps when used in an automotive application).

I. Composition

The amount of silicon (Si) and magnesium (Mg) in the new 6xxx aluminum alloys may relate to the improved combination of properties (e.g., strength, formability, corrosion resistance). Thus. silicon (Si) is included in the new 6xxx aluminum alloys, and generally in the range of from 1.00 wt. % to 1.45 wt. % Si. In one embodiment, a new 6xxx aluminum alloy includes from 1.03 wt. % to 1.40 wt. % Si. In another embodiment, a new 6xxx aluminum alloy includes from 1.06 wt. % to 1.35 wt. % Si. In yet another embodiment, a new 6xxx aluminum alloy includes from 1.09 wt. % to 1.30 wt. % Si.

Magnesium (Mg) is included in the new 6xxx aluminum alloy, and generally in the range of from 0.32 wt. % to 0.51 wt. % Mg. In one embodiment, a new 6xxx aluminum alloy includes from 0.34 wt. % to 0.49 wt. % Mg. In another embodiment, a new 6xxx aluminum alloy includes from 0.35 wt. % to 0.47 wt. % Mg. In another embodiment, a new 6xxx aluminum alloy includes from 0.36 wt. % to 0.46 wt. % Mg.

Generally, the new 6xxx aluminum alloy includes silicon and magnesium such that the wt. % of Si is equal to or greater than twice the wt. % of Mg, i.e., the ratio of wt. % Si to wt. % Mg is at least 2.0:1 (Si:Mg), but not greater than 4.5 (Si:Mg). In one embodiment, the ratio of wt. % Si to wt. % Mg is in the range of from 2.10:1 to 4.25 (Si:Mg). In another embodiment, the ratio of wt. % Si to wt. % Mg is in the range of from 2.20:1 to 4.00 (Si:Mg). In yet another embodiment, the ratio of wt. % Si to wt. % Mg is in the range of from 2.30:1 to 3.75 (Si:Mg). In another embodiment, the ratio of wt. % Si to wt. % Mg is in the range of from 2.40:1 to 3.60 (Si:Mg).

The amount of copper (Cu) in the new 6xxx aluminum alloys may relate to the improved combination of properties (e.g., corrosion resistance, formability). Copper (Cu) is included in the new 6xxx aluminum alloy, and generally in the range of from 0.12 wt. % to 0.45 wt. % Cu. In one approach, a new 6xxx aluminum alloy includes from 0.12 wt. % to 0.25 wt. % Cu. In one embodiment relating to this approach, a new 6xxx aluminum alloy includes from 0.12 wt. % to 0.22 wt. % Cu. In another embodiment relating to this approach, a new 6xxx aluminum alloy includes from 0.12 wt. % to 0.20 wt. % Cu. In another embodiment relating to this approach, a new 6xxx aluminum alloy includes from 0.15 wt. % to 0.25 wt. % Cu. In another embodiment relating to this approach, a new 6xxx aluminum alloy includes from 0.15 wt. % to 0.22 wt. % Cu. In another embodiment relating to this approach, a new 6xxx aluminum alloy includes from 0.15 wt. % to 0.20 wt. % Cu. In another approach, a new 6xxx aluminum alloy includes from 0.23 wt. % to 0.44 wt. % Cu. In one embodiment relating to this approach, a new 6xxx aluminum alloy includes from 0.25 wt. % to 0.42 wt. % Cu. In another embodiment relating to this approach, a new 6xxx aluminum alloy includes from 0.27 wt. % to 0.40 wt. % Cu.

Iron (Fe) is included in the new 6xxx aluminum alloy, and generally in the range of from 0.08 wt. % to 0.30 wt. % Fe. In one embodiment, a new 6xxx aluminum alloy includes from 0.08 wt. % to 0.19 wt. % Fe. In another embodiment, a new 6xxx aluminum alloy includes from 0.09 wt. % to 0.18 wt. % Fe. In yet another embodiment, a new 6xxx aluminum alloy includes from 0.09 wt. % to 0.17 wt. % Fe.

Both manganese (Mn) and chromium (Cr) are included in the new 6xxx aluminum alloys. The combination of Mn+Cr provides unique grain structure control in the heat treated product, resulting in an improved combination of properties, such as an improved combination of strength and formability as compared to alloys with only Mn or only Cr. In this regard, the new 6xxx aluminum alloys generally include from 0.02 wt. % to 0.09 wt. % Mn and from 0.01 wt. % to 0.06 wt. % Cr. In one embodiment, a new 6xxx aluminum alloy includes from 0.02 wt. % to 0.08 wt. % Mn and from 0.01 wt. % to 0.05 wt. % Cr. In another embodiment, a new 6xxx aluminum alloy includes from 0.02 wt. % to 0.08 wt. % Mn and from 0.015 wt. % to 0.045 wt. % Cr.

Titanium (Ti) is included in the new 6xxx aluminum alloy, and generally in the range of from 0.01 to 0.14 wt. % Ti. In one approach, a new 6xxx aluminum alloy includes from 0.01 to 0.05 wt. % Ti. In one embodiment relating to this approach, a new 6xxx aluminum alloy includes from 0.014 to 0.034 wt. % Ti. In another approach, a new 6xxx aluminum alloy includes from 0.06 to 0.14 wt. % Ti. In one embodiment relating to this approach, a new 6xxx aluminum alloy includes from 0.08 to 0.12 wt. % Ti. Higher titanium may be used to facilitate improved corrosion resistance.

Zinc (Zn) may optionally be included in the new 6xxx aluminum alloy, and in an amount up to 0.25 wt. % Zn. In one embodiment, a new 6xxx aluminum alloy may include up to 0.10 wt. % Zn. In another embodiment, a new 6xxx aluminum alloy may include up to 0.05 wt. % Zn. In yet another embodiment, a new 6xxx aluminum alloy may include up to 0.03 wt. % Zn.

As noted above, the balance of the new 6xxx aluminum alloy is aluminum and impurities. In one embodiment, the new 6xxx aluminum alloy includes not more than 0.05 wt. % each of any one impurity, with the total combined amount of these impurities not exceeding 0.15 wt. % in the new aluminum alloy. In another embodiment, the new 6xxx aluminum alloy includes not more than 0.03 wt. % each of any one impurity, with the total combined amount of these impurities not exceeding 0.10 wt. % in the new aluminum alloy.

Except where stated otherwise, the expression "up to" when referring to the amount of an element means that that elemental composition is optional and includes a zero amount of that particular compositional component. Unless stated otherwise, all compositional percentages are in weight percent (wt. %). The below table provides some non-limiting embodiments of new 6xxx aluminum alloys.

Embodiments of the New 6xxx Aluminum Alloys

All Values in Weight Percent

| Embodiment | Si | Mg | Si:Mg | Cu | Fe | Mn |
|---|---|---|---|---|---|---|
| 1 | 1.00-1.45 | 0.32-0.51 | 2.0-4.5 | 0.12-0.45 | 0.08-0.30 | 0.02-0.09 |
| 2 | 1.03-1.40 | 0.34-0.49 | 2.20-4.00 | 0.12-0.25, or 0.23-0.44 | 0.08-0.19 | 0.02-0.08 |
| 3 | 1.06-1.35 | 0.35-0.47 | 2.30-3.75 | 0.12-0.22, or 0.25-0.42 | 0.09-0.18 | 0.02-0.08 |
| 4 | 1.09-1.30 | 0.36-0.46 | 2:40-3.60 | 0.15-0.20, or 0.27-0.40 | 0.09-0.17 | 0.02-0.08 |

| Embodiment | Cr | Ti | Zn | Others, each | Others, total | Bal. |
|---|---|---|---|---|---|---|
| 1 | 0.01-0.06 | 0.01-0.14 | ≤0.25 | ≤0.05 | ≤0.15 | Al |
| 2 | 0.01-0.05 | 0.01-0.05, or 0.06-0.14 | ≤0.10 | ≤0.05 | ≤0.15 | Al |
| 3 | 0.015-0.045 | 0.014-0.034, or 0.08-0.12 | ≤0.05 | ≤0.05 | ≤0.15 | Al |
| 4 | 0.015-0.045 | 0.014-0.034, or 0.08-0.12 | ≤0.03 | ≤0.03 | ≤0.10 | Al |

II. Processing

Referring now to FIG. 1, one method of manufacturing a 6xxx aluminum alloy strip is shown. In this embodiment, a continuously-cast aluminum 6xxx aluminum alloy strip feedstock 1 is optionally passed through shear and trim stations 2, and optionally trimmed 8 before solution heat-treating. The temperature of the heating step and the subsequent quenching step will vary depending on the desired temper. In other embodiments, quenching may occur between any steps of the flow diagram, such as between casting 1 and shear and trim 2. In further embodiments, coiling may occur after rolling 6 followed by offline cold work or solution heat treatment. In other embodiments, the production method may utilize the casting step as the solutionizing step, and thus may be free of any solution heat treatment or anneal, as described in co-owned U.S. Patent Application Publication No. US2014/0000768, which is incorporated herein by reference in its entirety. In one embodiment, an aluminum alloy strip is coiled after the quenching. The coiled product (e.g., in the T4 or T43 temper) may be shipped to a customer (e.g. for use in producing formed automotive pieces/parts, such as formed automotive panels.) The customer may paint bake and/or otherwise thermally treat (e.g., artificially age) the formed product to achieve a final tempered product (e.g., in a T6 temper, which may be a near peak strength T6 temper, as described below).

FIG. 2 shows schematically an apparatus for one of many alternative embodiments in which additional heating and rolling steps are carried out. Metal is heated in a furnace 80 and the molten metal is held in melter holders 81, 82. The molten metal is passed through troughing 84 and is further prepared by degassing 86 and filtering 88. The tundish 90 supplies the molten metal to the continuous caster 92, exemplified as a belt caster, although not limited to this. The metal feedstock 94 which emerges from the caster 92 is moved through optional shear 96 and trim 98 stations for edge trimming and transverse cutting, after which it is passed to an optional quenching station 100 for adjustment of rolling temperature. After quenching 100, the feedstock 94 is passed through a rolling mill 102, from which it emerges at an intermediate thickness. The feedstock 94 is then subjected to additional hot milling (rolling) 104 and optionally cold milling (rolling) 106, 108 to reach the desired final gauge. Cold milling (rolling) may be performed in-line as shown or offline.

As used herein, the term "feedstock" refers to the aluminum alloy in strip form. The feedstock employed in the practice of the present invention can be prepared by any number of continuous casting techniques well known to those skilled in the art. A preferred method for making the strip is described in U.S. Pat. No. 5,496,423 issued to Wyatt-Mair and Harrington. Another preferred method is as described in application Ser. No. 10/078,638 (now U.S. Pat. No. 6,672,368) and Ser. No. 10/377,376, both of which are assigned to the assignee of the present invention. Typically, the cast strip will have a width of from about 43 to 254 cm (about 17 to 100 inches), depending on desired continued processing and the end use of the strip. The feedstock generally enters the first rolling station (sometimes referred to as "stand" herein) with a suitable rolling thickness (e.g., of from 1.524 to 10.160 mm (0.060 to 0.400 inch)). The final gauge thickness of the strip after the rolling stand(s) may be in the range of from 0.1524 to 4.064 mm (0.006 to 0.160 inch). In one embodiment, the final gauge thickness of the strip is in the range of from 0.8 to 3.0 mm (0.031 to 0.118 inch).

In general, the quench at station 100 reduces the temperature of the feedstock as it emerges from the continuous caster from a temperature of 850 to 1050° F. to the desired rolling temperature (e.g. hot or cold rolling temperature). In general, the feedstock will exit the quench at station 100 with a temperature ranging from 100 to 950° F., depending on alloy and temper desired. Water sprays or an air quench may be used for this purpose. In another embodiment, quenching reduces the temperature of the feedstock from 900 to 950° F. to 800 to 850° F. In another embodiment, the feedstock will exit the quench at station 51 with a temperature ranging from 600 to 900° F.

Hot rolling 102 is typically carried out at temperatures within the range from 400 to 1000° F., preferably 400 to 900° F., more preferably 700 to 900° F. Cold rolling is typically carried out at temperatures from ambient temperature to less than 400° F. When hot rolling, the temperature of the strip at the exit of a hot rolling stand may be between 100 and 800° F., preferably 100 to 550° F., since the strip may be cooled by the rolls during rolling.

The heating carried out at the heater 112 is determined by the alloy and temper desired in the finished product. In one preferred embodiment, the feedstock will be solution heat-treated in-line, at the anneal or solution heat treatment temperatures described below.

As used herein, the term "anneal" refers to a heating process that causes recovery and/or recrystallization of the metal to occur (e.g., to improve formability). Typical temperatures used in annealing aluminum alloys range from 500 to 900° F. Products that have been annealed may be quenched, preferably air- or water-quenched, to 110 to 720° F., and then coiled. Annealing may be performed after rolling (e.g. hot rolling), before additional cold rolling to reach the final gauge. In this embodiment, the feed stock proceeds through rolling via at least two stands, annealing, cold rolling, optionally trimming, solution heat-treating in-line or offline, and quenching. Additional steps may include tension-leveling and coiling. It may be appreciated that annealing may be performed in-line as illustrated, or off-line through batch annealing.

In one embodiment, the feedstock 94 is then optionally trimmed 110 and then solution heat-treated in heater 112. Following solution heat treatment in the heater 112, the feedstock 94 optionally passes through a profile gauge 113, and is optionally quenched at quenching station 114. The resulting strip may be subjected to x-ray 116, 118 and surface inspection 120 and then optionally coiled. The solution heat treatment station may be placed after the final gauge is reached, followed by the quench station. Additional in-line anneal steps and quenches may be placed between rolling steps for intermediate anneal and for keeping solute in solution, as needed.

Also as used herein, the term "solution heat treatment" refers to a metallurgical process in which the metal is held at a high temperature so as to cause second phase particles of the alloying elements to at least partially dissolve into solid solution (e.g. completely dissolve second phase particles). When solution heat treating, the heating is generally carried out at a temperature and for a time sufficient to ensure solutionizing of the alloy but without incipient melting of the aluminum alloy. Solution heat treating facilitates production of T tempers. Temperatures used in solution heat treatment are generally higher than those used in annealing, but below the incipient melting point of the alloy, such as temperatures in the range of from 905° F. to up to 1060° F. In one embodiment, the solution heat treatment temperature is at least 950° F. In another embodiment, the solution heat treatment temperature is at least 960° F. In yet another embodiment, the solution heat treatment temperature is at least 970° F. In another embodiment, the solution heat treatment temperature is at least 980° F. In yet another embodiment, the solution heat treatment temperature is at least 990° F. In another embodiment, the solution heat treatment temperature is at least 1000° F. In one embodiment, the solution heat treatment temperature is not greater than least 1050° F. In another embodiment, the solution heat treatment temperature is not greater than least 1040° F. In another embodiment, the solution heat treatment temperature is not greater than least 1030° F. In one embodiment, solution heat treatment is at a temperature at least from 950° to 1060° F. In another embodiment, the solution heat treatment is at a temperature of from 960° to 1060° F. In yet another embodiment, the solution heat treatment is at a temperature of from 970° to 1050° F. In another embodiment, the solution heat treatment is at a temperature of from 980° to 1040° F. In yet another embodiment, the solution heat treatment is at a temperature of from 990° to 1040° F. In another embodiment, the solution heat treatment is at a temperature of from 1000° to 1040° F.

Feedstock which has been solution heat-treated will generally be quenched to achieve a T temper, preferably air and/or water quenched, to 70 to 250° F., preferably to 100 to 200° F. and then coiled. In another embodiment, feedstock which has been solution heat-treated will be quenched, preferably air and/or water quenched to 70 to 250° F., preferably 70 to 180° F. and then coiled. Preferably, the quench is a water quench or an air quench or a combined quench in which water is applied first to bring the temperature of the strip to just above the Leidenfrost temperature (about 550° F. for many aluminum alloys) and is continued by an air quench. This method will combine the rapid cooling advantage of water quench with the low stress quench of airjets that will provide a high quality surface in the product and will minimize distortion. For heat treated products, an exit temperature of about 250° F. or below is preferred. Any of a variety of quenching devices may be used in the practice of the present invention. Typically, the quenching station is one in which a cooling fluid, either in liquid or gaseous form is sprayed onto the hot feedstock to rapidly reduce its temperature. Suitable cooling fluids include water, air, liquefied gases such as carbon dioxide, and the like. It is preferred that the quench be carried out quickly to reduce the temperature of the hot feedstock rapidly to prevent substantial precipitation of alloying elements from solid solution.

After the solution heat treating and quenching, the new 6xxx aluminum alloys may be naturally aged, e.g., to a T4 or T43 temper. In some embodiments, after the natural aging, a coiled new 6xxx aluminum alloy product is shipped to a customer for further processing.

After any natural aging, the new 6xxx aluminum alloys may be artificially aged to develop precipitation hardening precipitates. The artificial aging may include heating the new 6xxx aluminum alloys at one or more elevated temperatures (e.g., from 93.3° to 232.2° C. (200° to 450° F.)) for one or more periods of time (e.g., for several minutes to several hours). The artificial aging may include paint baking of the new 6xxx aluminum alloy (e.g., when the aluminum alloy is used in an automotive application). Artificial aging may optionally be performed prior to paint baking (e.g., after forming the new 6xxx aluminum alloy into an automotive component). Additional artificial aging after any paint bake may also be completed, as necessary/appropriate. In one embodiment, the final 6xxx aluminum alloy product is in a T6 temper, meaning the final 6xxx aluminum alloy product has been solution heat treated, quenched, and artificially aged. The artificial aging does not necessarily require aging to peak strength, but the artificial aging could be completed to achieve peak strength, or near peak-aged strength (near peak-aged means within 10% of peak strength).

III. Multiple Rolling Stands

In one embodiment, the new 6xxx aluminum alloys described herein may be processed using multiple rolling stands when being continuously cast. For instance, one embodiment of a method of manufacturing a 6xxx aluminum alloy strip in a continuous in-line sequence may include the steps of (i) providing a continuously-cast 6xxx aluminum alloy strip as feedstock; (ii) rolling (e.g. hot rolling and/or cold rolling) the 6xxx aluminum alloy feedstock to the required thickness in-line via at least two stands, optionally to the final product gauge. After the rolling, the 6xxx aluminum alloy feedstock may be (iii) solution heat-treated and (iv) quenched. After the solution heat treating and quenching, the 6xxx aluminum alloy strip may be (v) artificially aged (e.g., via a paint bake). Optional additional steps include off-line cold rolling (e.g., immediately before or after solution heat treating), tension leveling and coiling. This method may result in an aluminum alloy strip having an improved combination of properties (e.g., an improved combination of strength and formability).

The extent of the reduction in thickness affected by the rolling steps is intended to reach the required finish gauge or intermediate gauge, either of which can be a target thickness. As shown in the below examples, using two rolling stands facilitates an unexpected and improved combination of properties. In one embodiment, the combination of the first rolling stand plus the at least second rolling stand reduces the as-cast (casting) thickness by from 15% to 80% to achieve a target thickness. The as-cast (casting) gauge of the strip may be adjusted so as to achieve the appropriate total reduction over the at least two rolling stands to achieve the target thickness. In another embodiment, the combination of the first rolling stand plus the at least second rolling stand may reduce the as-cast (casting) thickness by at least 25%. In yet another embodiment, the combination of the first rolling stand plus the at least second rolling stand may reduce the as-cast (casting) thickness by at least 30%. In another embodiment, the combination of the first rolling stand plus the at least second rolling stand may reduce the as-cast (casting) thickness by at least 35%. In yet another embodiment, the combination of the first rolling stand plus the at least second rolling stand may reduce the as-cast (casting) thickness by at least 40%. In any of these embodiments, the combination of the first hot rolling stand plus the at least second hot rolling stand may reduce the as-cast (casting) thickness by not greater than 75%. In any of these embodiments, the combination of the first hot rolling stand plus the at least second hot rolling stand may reduce the as-cast (casting) thickness by not greater than 65%. In any of these embodiments, the combination of the first hot rolling stand plus the at least second hot rolling stand may reduce the as-cast (casting) thickness by not greater than 60%. In any of these embodiments, the combination of the first hot rolling stand plus the at least second hot rolling stand may reduce the as-cast (casting) thickness by not greater than 55%.

In one approach, the combination of the first rolling stand plus the at least second rolling stand reduces the as-cast (casting) thickness by from 15% to 75% to achieve a target thickness. In one embodiment, the combination of the first rolling stand plus the at least second rolling stand reduces the as-cast (casting) thickness by from 15% to 70% to achieve a target thickness. In another embodiment, the combination of the first rolling stand plus the at least second rolling stand reduces the as-cast (casting) thickness by from 15% to 65% to achieve a target thickness. In yet another embodiment, the combination of the first rolling stand plus the at least second rolling stand reduces the as-cast (casting) thickness by from 15% to 60% to achieve a target thickness. In another embodiment, the combination of the first rolling stand plus the at least second rolling stand reduces the as-cast (casting) thickness by from 15% to 55% to achieve a target thickness.

In another approach, the combination of the first rolling stand plus the at least second rolling stand reduces the as-cast (casting) thickness by from 20% to 75% to achieve a target thickness. In one embodiment, the combination of the first rolling stand plus the at least second rolling stand reduces the as-cast (casting) thickness by from 20% to 70% to achieve a target thickness. In another embodiment, the combination of the first rolling stand plus the at least second rolling stand reduces the as-cast (casting) thickness by from 20% to 65% to achieve a target thickness. In yet another embodiment, the combination of the first rolling stand plus the at least second rolling stand reduces the as-cast (casting) thickness by from 20% to 60% to achieve a target thickness. In another embodiment, the combination of the first rolling stand plus the at least second rolling stand reduces the as-cast (casting) thickness by from 20% to 55% to achieve a target thickness.

In another approach, the combination of the first rolling stand plus the at least second rolling stand reduces the as-cast (casting) thickness by from 25% to 75% to achieve a target thickness. In one embodiment, the combination of the first rolling stand plus the at least second rolling stand reduces the as-cast (casting) thickness by from 25% to 70% to achieve a target thickness. In another embodiment, the combination of the first rolling stand plus the at least second rolling stand reduces the as-cast (casting) thickness by from 25% to 65% to achieve a target thickness. In yet another embodiment, the combination of the first rolling stand plus the at least second rolling stand reduces the as-cast (casting) thickness by from 25% to 60% to achieve a target thickness. In another embodiment, the combination of the first rolling stand plus the at least second rolling stand reduces the as-cast (casting) thickness by from 25% to 55% to achieve a target thickness.

In another approach, the combination of the first rolling stand plus the at least second rolling stand reduces the as-cast (casting) thickness by from 30% to 75% to achieve a target thickness. In one embodiment, the combination of the first rolling stand plus the at least second rolling stand reduces the as-cast (casting) thickness by from 30% to 70% to achieve a target thickness. In another embodiment, the combination of the first rolling stand plus the at least second rolling stand reduces the as-cast (casting) thickness by from 30% to 65% to achieve a target thickness. In yet another embodiment, the combination of the first rolling stand plus the at least second rolling stand reduces the as-cast (casting) thickness by from 30% to 60% to achieve a target thickness.

In another embodiment, the combination of the first rolling stand plus the at least second rolling stand reduces the as-cast (casting) thickness by from 30% to 55% to achieve a target thickness.

In another approach, the combination of the first rolling stand plus the at least second rolling stand reduces the as-cast (casting) thickness by from 35% to 75% to achieve a target thickness. In one embodiment, the combination of the first rolling stand plus the at least second rolling stand reduces the as-cast (casting) thickness by from 35% to 70% to achieve a target thickness. In another embodiment, the combination of the first rolling stand plus the at least second rolling stand reduces the as-cast (casting) thickness by from 35% to 65% to achieve a target thickness. In yet another embodiment, the combination of the first rolling stand plus the at least second rolling stand reduces the as-cast (casting) thickness by from 35% to 60% to achieve a target thickness. In another embodiment, the combination of the first rolling stand plus the at least second rolling stand reduces the as-cast (casting) thickness by from 35% to 55% to achieve a target thickness.

In another approach, the combination of the first rolling stand plus the at least second rolling stand reduces the as-cast (casting) thickness by from 40% to 75% to achieve a target thickness. In one embodiment, the combination of the first rolling stand plus the at least second rolling stand reduces the as-cast (casting) thickness by from 40% to 70% to achieve a target thickness. In another embodiment, the combination of the first rolling stand plus the at least second rolling stand reduces the as-cast (casting) thickness by from 40% to 65% to achieve a target thickness. In yet another embodiment, the combination of the first rolling stand plus the at least second rolling stand reduces the as-cast (casting) thickness by from 40% to 60% to achieve a target thickness. In another embodiment, the combination of the first rolling stand plus the at least second rolling stand reduces the as-cast (casting) thickness by from 40% to 55% to achieve a target thickness.

Regarding the first rolling stand, in one embodiment, a thickness reduction of 1-50% is accomplished by the first rolling stand, the thickness reduction being from a casting thickness to an intermediate thickness. In one embodiment, the first rolling stand reduces the as-cast (casting) thickness by 5-45%. In another embodiment, the first rolling stand reduces the as-cast (casting) thickness by 10-45%. In yet another embodiment, the first rolling stand reduces the as-cast (casting) thickness by 11-40%. In another embodiment, the first rolling stand reduces the as-cast (casting) thickness by 12-35%. In yet another embodiment, the first rolling stand reduces the as-cast (casting) thickness by 12-34%. In another embodiment, the first rolling stand reduces the as-cast (casting) thickness by 13-33%. In yet another embodiment, the first rolling stand reduces the as-cast (casting) thickness by 14-32%. In another embodiment, the first rolling stand reduces the as-cast (casting) thickness by 15-31%. In yet another embodiment, the first rolling stand reduces the as-cast (casting) thickness by 16-30%. In another embodiment, the first rolling stand reduces the as-cast (casting) thickness by 17-29%.

The second rolling stand (or combination of second rolling stand plus any additional rolling stands) achieves a thickness reduction of 1-70% relative to the intermediate thickness achieved by the first rolling stand. Using math, the skilled person can select the appropriate second rolling stand (or combination of second rolling stand plus any additional rolling stands) reduction based on the total reduction required to achieve the target thickness, and the amount of reduction achieved by the first rolling stand.

$$\text{Target thickness}=\text{Cast-gauge thickness}*(\%\text{ reduction by the } 1^{st}\text{ stand})*(\%\text{ reduction by } 2^{nd}\text{ and any subsequent stand(s)}) \quad (1)$$

$$\text{Total reduction to achieve target thickness}=1^{st}\text{ stand reduction}+2^{nd}\text{ (or more) stand reduction} \quad (2)$$

In one embodiment, the second rolling stand (or combination of second rolling stand plus any additional rolling stands) achieves a thickness reduction of 5-70% relative to the intermediate thickness achieved by the first rolling stand. In another embodiment, the second rolling stand (or combination of second rolling stand plus any additional rolling stands) achieves a thickness reduction of 10-70% relative to the intermediate thickness achieved by the first rolling stand. In yet another embodiment, the second rolling stand (or combination of second rolling stand plus any additional rolling stands) achieves a thickness reduction of 15-70% relative to the intermediate thickness achieved by the first rolling stand. In another embodiment, the second rolling stand (or combination of second rolling stand plus any additional rolling stands) achieves a thickness reduction of 20-70% relative to the intermediate thickness achieved by the first rolling stand. In yet another embodiment, the second rolling stand (or combination of second rolling stand plus any additional rolling stands) achieves a thickness reduction of 25-70% relative to the intermediate thickness achieved by the first rolling stand. In another embodiment, the second rolling stand (or combination of second rolling stand plus any additional rolling stands) achieves a thickness reduction of 30-70% relative to the intermediate thickness achieved by the first rolling stand. In yet another embodiment, the second rolling stand (or combination of second rolling stand plus any additional rolling stands) achieves a thickness reduction of 35-70% relative to the intermediate thickness achieved by the first rolling stand. In another embodiment, the second rolling stand (or combination of second rolling stand plus any additional rolling stands) achieves a thickness reduction of 40-70% relative to the intermediate thickness achieved by the first rolling stand.

When using multiple rolling stands any suitable number of hot and cold rolling stands may be used to reach the appropriate target thickness. For instance, the rolling mill arrangement for thin gauges could comprise a hot rolling step, followed by hot and/or cold rolling steps as needed.

IV. Properties

As mentioned above, the new 6xxx aluminum alloys may realize an improved combination of properties. In one embodiment, the improved combination of properties relates to an improved combination of strength and formability. In one embodiment, the improved combination of properties relates to an improved combination of strength, formability and corrosion resistance.

The 6xxx aluminum alloy product may realize, in a naturally aged condition, a tensile yield strength (LT) of from 100 to 170 MPa when measured in accordance with ASTM B557. For instance, after solution heat treatment, optional stress relief (e.g., via stretching or leveling), and natural aging, the 6xxx aluminum alloy product may realize a tensile yield strength (LT) of from 100 to 170 MPa, such as in one of the T4 or T43 temper. The naturally aged strength in the T4 or T43 temper is to be measured at 30 days of natural aging.

In one embodiment, a new 6xxx aluminum alloy in the T4 temper may realize a tensile yield strength (LT) of at least 130 MPa. In another embodiment, a new 6xxx aluminum alloy in the T4 temper may realize a tensile yield strength (LT) of at least 135 MPa. In yet another embodiment, a new 6xxx aluminum alloy in the T4 temper may realize a tensile yield strength (LT) of at least 140 MPa. In another embodiment, a new 6xxx aluminum alloy in the T4 temper may realize a tensile yield strength (LT) of at least 145 MPa. In yet another embodiment, a new 6xxx aluminum alloy in the T4 temper may realize a tensile yield strength (LT) of at least 150 MPa. In another embodiment, a new 6xxx aluminum alloy in the T4 temper may realize a tensile yield strength (LT) of at least 155 MPa. In yet another embodiment, a new 6xxx aluminum alloy in the T4 temper may realize a tensile yield strength (LT) of at least 160 MPa. In another embodiment, a new 6xxx aluminum alloy in the T4 temper may realize a tensile yield strength (LT) of at least 165 MPa, or more.

In one embodiment, a new 6xxx aluminum alloy in the T43 temper may realize a tensile yield strength (LT) of at least 110 MPa. In another embodiment, a new 6xxx aluminum alloy in the T43 temper may realize a tensile yield strength (LT) of at least 115 MPa. In yet another embodiment, a new 6xxx aluminum alloy in the T43 temper may realize a tensile yield strength (LT) of at least 120 MPa. In another embodiment, a new 6xxx aluminum alloy in the T43 temper may realize a tensile yield strength (LT) of at least 125 MPa. In yet another embodiment, a new 6xxx aluminum alloy in the T43 temper may realize a tensile yield strength (LT) of at least 130 MPa. In another embodiment, a new 6xxx aluminum alloy in the T43 temper may realize a tensile yield strength (LT) of at least 135 MPa. In yet another embodiment, a new 6xxx aluminum alloy in the T43 temper may realize a tensile yield strength (LT) of at least 140 MPa. In another embodiment, a new 6xxx aluminum alloy in the T43 temper may realize a tensile yield strength (LT) of at least 145 MPa, or more.

The 6xxx aluminum alloy product may realize, in an artificially aged condition, a tensile yield strength (LT) of from 160 to 330 MPa when measured in accordance with ASTM B557. For instance, after solution heat treatment, optional stress relief, and artificial aging, a new 6xxx aluminum alloy product may realized a near peak strength of from 160 to 330 MPa. In one embodiment, new 6xxx aluminum alloys may realize a tensile yield strength (LT) of at least 165 MPa (e.g., when aged to near peak strength). In another embodiment, new 6xxx aluminum alloys may realize a tensile yield strength (LT) of at least 170 MPa. In yet another embodiment, new 6xxx aluminum alloys may realize a tensile yield strength (LT) of at least 175 MPa. In another embodiment, new 6xxx aluminum alloys may realize a tensile yield strength (LT) of at least 180 MPa. In yet another embodiment, new 6xxx aluminum alloys may realize a tensile yield strength (LT) of at least 185 MPa. In another embodiment, new 6xxx aluminum alloys may realize a tensile yield strength (LT) of at least 190 MPa. In yet another embodiment, new 6xxx aluminum alloys may realize a tensile yield strength (LT) of at least 195 MPa. In another embodiment, new 6xxx aluminum alloys may realize a tensile yield strength (LT) of at least 200 MPa. In yet another embodiment, new 6xxx aluminum alloys may realize a tensile yield strength (LT) of at least 205 MPa. In another embodiment, new 6xxx aluminum alloys may realize a tensile yield strength (LT) of at least 210 MPa. In yet another embodiment, new 6xxx aluminum alloys may realize a tensile yield strength (LT) of at least 215 MPa. In another embodiment, new 6xxx aluminum alloys may realize a tensile yield strength (LT) of at least 220 MPa. In yet another embodiment, new 6xxx aluminum alloys may realize a tensile yield strength (LT) of at least 225 MPa. In another embodiment, new 6xxx aluminum alloys may realize a tensile yield strength (LT) of at least 230 MPa. In yet another embodiment, new 6xxx aluminum alloys may realize a tensile yield strength (LT) of at least 235 MPa. In another embodiment, new 6xxx aluminum alloys may realize a tensile yield strength (LT) of at least 240 MPa. In yet another embodiment, new 6xxx aluminum alloys may realize a tensile yield strength (LT) of at least 245 MPa. In another embodiment, new 6xxx aluminum alloys may realize a tensile yield strength (LT) of at least 250 MPa, or more.

In one embodiment, the new 6xxx aluminum alloys realize an $FLD_o$ of from 28.0 to 33.0 (Engr %) at a gauge of 1.0 mm when measured in accordance with ISO 12004-2: 2008 standard, wherein the ISO standard is modified such that fractures more than 15% of the punch diameter away from the apex of the dome are counted as valid. In one embodiment, the new 6xxx aluminum alloys realize an $FLD_o$ of at least 28.5 (Engr %). In another embodiment, the new 6xxx aluminum alloys realize an $FLD_o$ of at least 29.0 (Engr %). In yet another embodiment, the new 6xxx aluminum alloys realize an $FLD_o$ of at least 29.5 (Engr %). In another embodiment, the new 6xxx aluminum alloys realize an $FLD_o$ of at least 30.0 (Engr %). In yet another embodiment, the new 6xxx aluminum alloys realize an $FLD_o$ of at least 30.5 (Engr %). In another embodiment, the new 6xxx aluminum alloys realize an $FLD_o$ of at least 31.0 (Engr %). In yet another embodiment, the new 6xxx aluminum alloys realize an $FLD_o$ of at least 31.5 (Engr %). In another embodiment, the new 6xxx aluminum alloys realize an $FLD_o$ of at least 32.0 (Engr %). In yet another embodiment, the new 6xxx aluminum alloys realize an $FLD_o$ of at least 32.5 (Engr %), or more.

The new 6xxx aluminum alloys may realize good intergranular corrosion resistance when tested in accordance with ISO standard 11846(1995) (Method B), such as realizing a depth of attack measurement of not greater than 350 microns (e.g., in the near peak-aged, as defined above, condition). In one embodiment, the new 6xxx aluminum alloys may realize a depth of attack of not greater than 340 microns. In another embodiment, the new 6xxx aluminum alloys may realize a depth of attack of not greater than 330 microns. In yet another embodiment, the new 6xxx aluminum alloys may realize a depth of attack of not greater than 320 microns. In another embodiment, the new 6xxx aluminum alloys may realize a depth of attack of not greater than 310 microns. In yet another embodiment, the new 6xxx aluminum alloys may realize a depth of attack of not greater than 300 microns. In another embodiment, the new 6xxx aluminum alloys may realize a depth of attack of not greater than 290 microns. In yet another embodiment, the new 6xxx aluminum alloys may realize a depth of attack of not greater than 280 microns. In another embodiment, the new 6xxx aluminum alloys may realize a depth of attack of not greater than 270 microns. In yet another embodiment, the new 6xxx aluminum alloys may realize a depth of attack of not greater than 260 microns. In another embodiment, the new 6xxx aluminum alloys may realize a depth of attack of not greater than 250 microns. In yet another embodiment, the new 6xxx aluminum alloys may realize a depth of attack of not greater than 240 microns. In another embodiment, the new 6xxx aluminum alloys may realize a depth of attack of not greater than 230 microns. In yet another embodiment, the new 6xxx aluminum alloys may realize a depth of attack of not greater than 220 microns. In another embodiment, the new 6xxx aluminum alloys may realize a depth of attack of not greater than 210 microns. In yet another embodiment, the new 6xxx aluminum alloys may realize a depth of attack of not greater than 200 microns, or less.

The new 6xxx aluminum alloy strip products described herein may find use in a variety of product applications. In one embodiment, a new 6xxx aluminum alloy product made by the new processes described herein is used in an automotive application, such as closure panels (e.g., hoods, fenders, doors, roofs, and trunk lids, among others), and body-in-white (e.g., pillars, reinforcements) applications, among others.

DETAILED DESCRIPTION

Examples

Figure 1:
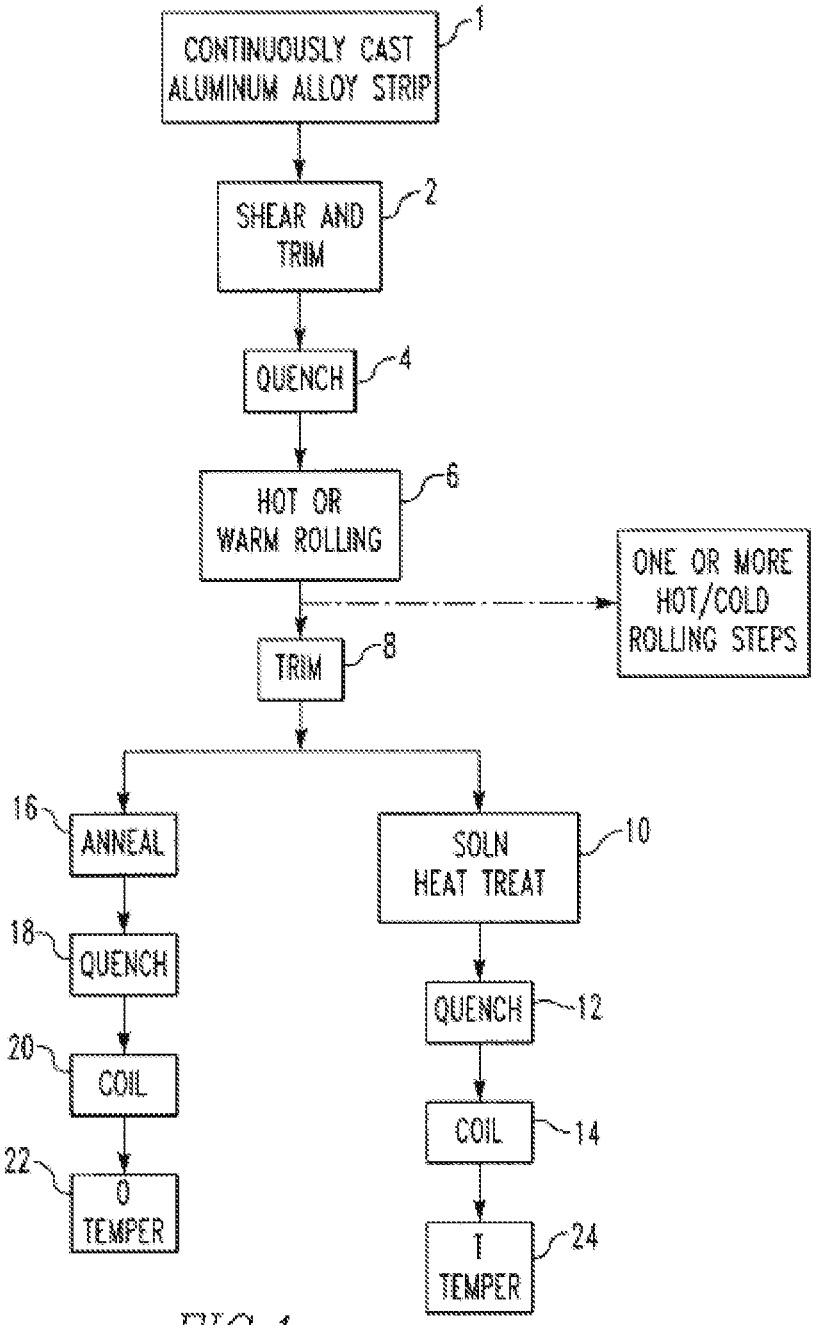
FIG. 1 is a flow chart illustrating one embodiment of processing steps of the present invention.
Figure 2:
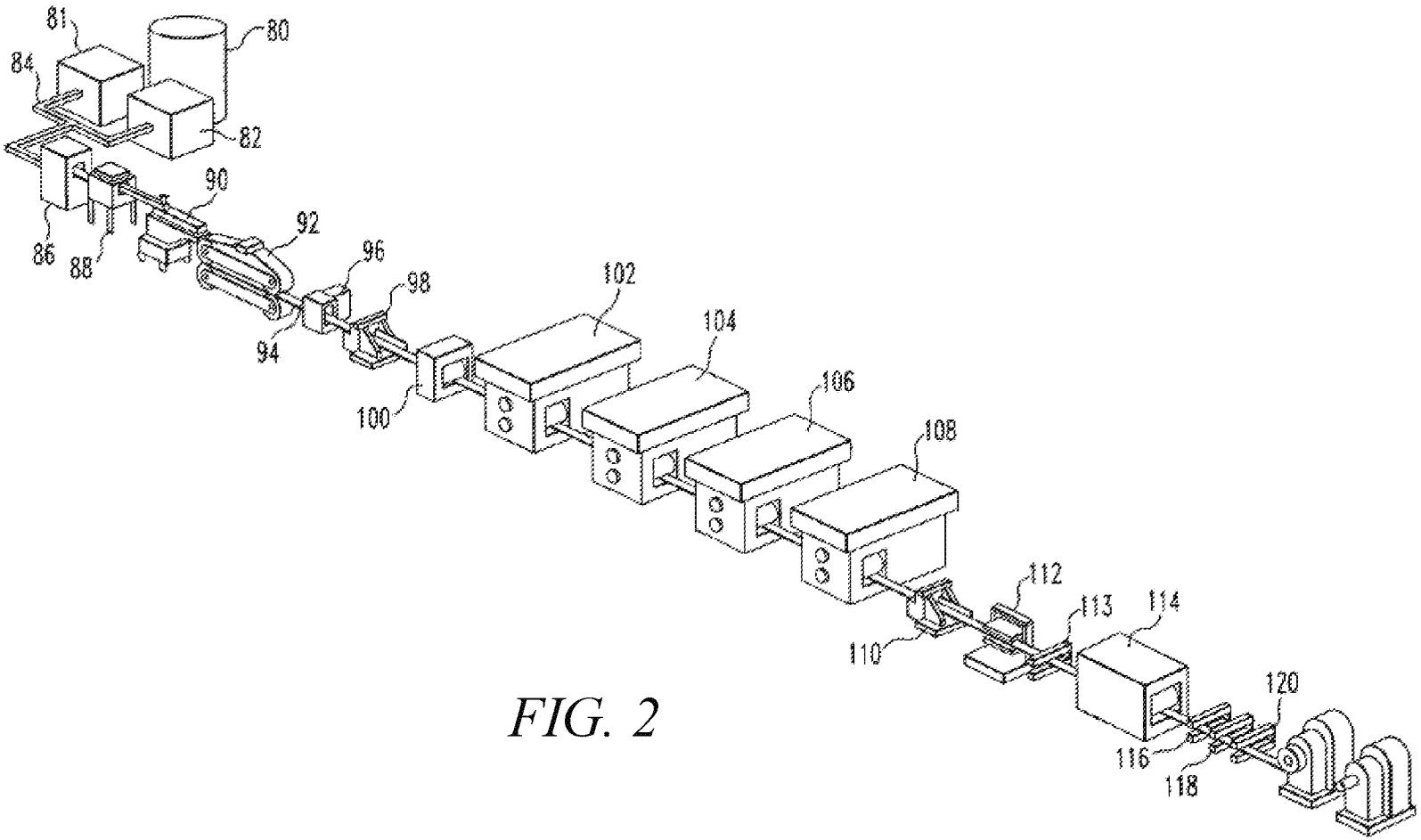
FIG. 2 is an additional embodiment of the apparatus used in carrying out the method of the present invention. This line is equipped with four rolling mills to reach a finer finished gauge.

The following examples are intended to illustrate the invention and should not be construed as limiting the invention in any way.

Example 1

Two 6xxx aluminum alloys were continuously cast, and then rolled to an intermediate gauge in-line over two rolling stands. These 6xxx aluminum alloys were then cold rolled (off-line) to final gauge, then solution heat treated, then quenched, and then naturally aged for several days. Various mechanical properties of these alloys were then measured. The compositions, various processing conditions, and various properties of these alloys are shown in Tables 1-4, below.

TABLE 1

Compositions of Continuously Cast 6xxx Aluminum Alloys (in wt. %)

| Material | Si | Fe | Cu | Mn | Mg | Cr | Zn | Ti |
|---|---|---|---|---|---|---|---|---|
| Alloy CC1 | 1.14 | 0.16 | 0.15 | 0.05 | 0.38 | 0.02 | 0.01 | 0.09 |
| Alloy CC2 | 1.13 | 0.17 | 0.34 | 0.05 | 0.38 | 0.02 | 0.01 | 0.08 |

The balance of the alloys was aluminum and unavoidable impurities.

TABLE 2

Processing Parameters for Continuously Cast 6xxx Aluminum Alloys

| Material | Lot No. | Cast Gauge (in.) | Final Gauge (in.) | 1st Stand Reduction (%) (HR) (inline) | 2nd Stand Reduction (%) (HR) (inline) | Offline Cold Rolling Reduction (%) (CR) |
|---|---|---|---|---|---|---|
| Alloy CC1 | 531 | 0.140 | 0.0453 | 25 | 42 | 26 |
| Alloy CC1 | 471 | 0.140 | 0.0591 | 25 | 24 | 26 |
| Alloy CC2 | 541 | 0.140 | 0.0453 | 25 | 42 | 26 |
| Alloy CC2 | 511 | 0.140 | 0.0591 | 25 | 24 | 26 |

TABLE 3

Mechanical Properties for Continuously Cast 6xxx Aluminum Alloys

| Material | Lot No. | Final Gauge (in.) | Natural Age (days) | Meas. Direction | TYS (MPa) | UTS (MPa) | U. Elong. (%) | T. Elong. (%) |
|---|---|---|---|---|---|---|---|---|
| Alloy CC1 | 531 | 0.0453 | 14 | L | 140 | 248 | 26.3 | 32.8 |
| Alloy CC1 | 531 | 0.0453 | 14 | LT | 139 | 249 | 24.5 | 31.6 |
| Alloy CC1 | 531 | 0.0453 | 14 | 45 | 139 | 248 | 25.0 | 30.0 |
| Alloy CC1 | 531 | 0.0453 | 30 | L | 144 | 251 | 25.0 | 31.0 |
| Alloy CC1 | 531 | 0.0453 | 30 | LT | 141 | 251 | 25.5 | 31.1 |
| Alloy CC1 | 531 | 0.0453 | 30 | 45 | 142 | 252 | 26.1 | 31.4 |
| Alloy CC1 | 471 | 0.0591 | 14 | L | 140 | 247 | 25.5 | 29.5 |
| Alloy CC1 | 471 | 0.0591 | 14 | LT | 139 | 249 | 25.0 | 31.0 |
| Alloy CC1 | 471 | 0.0591 | 14 | 45 | 139 | 246 | 24.0 | 29.7 |
| Alloy CC1 | 471 | 0.0591 | 30 | L | 145 | 251 | 23.8 | 29.4 |
| Alloy CCI | 471 | 0.0591 | 30 | LT | 143 | 252 | 24.5 | 30.4 |
| Alloy CC1 | 471 | 0.0591 | 30 | 45 | 142 | 249 | 25.2 | 31.2 |
| Alloy CC2 | 541 | 0.0453 | 14 | L | 142 | 257 | 26.4 | 30.3 |
| Alloy CC2 | 541 | 0.0453 | 14 | LT | 141 | 258 | 25.2 | 30.2 |
| Alloy CC2 | 541 | 0.0453 | 14 | 45 | 139 | 255 | 26.8 | 31.2 |
| Alloy CC2 | 511 | 0.0591 | 14 | L | 145 | 258 | 25.2 | 30.3 |
| Alloy CC2 | 511 | 0.0591 | 14 | LT | 143 | 257 | 25.3 | 29.8 |
| Alloy CC2 | 511 | 0.0591 | 14 | 45 | 143 | 256 | 24.5 | 29.4 |
| Alloy CC2 | 541 | 0.0453 | 30 | L | 148 | 263 | 25.9 | 31.2 |
| Alloy CC2 | 541 | 0.0453 | 30 | LT | 144 | 262 | 25.5 | 30.1 |
| Alloy CC2 | 541 | 0.0453 | 30 | 45 | 144 | 261 | 26.5 | 31.6 |
| Alloy CC2 | 511 | 0.0591 | 30 | L | 150 | 261 | 25.3 | 30.0 |
| Alloy CC2 | 511 | 0.0591 | 30 | LT | 147 | 261 | 23.2 | 27.2 |
| Alloy CC2 | 511 | 0.0591 | 30 | 45 | 147 | 261 | 24.7 | 30.8 |

TABLE 4

Add'tl Mechanical Properties for Continuously Cast 6xxx Aluminum Alloys

| Material | Lot No. | Final Gauge (in.) | Natural Age (days) | Meas. Direction | R Value | Delta R | $FLD_o$ (Engr%) |
|---|---|---|---|---|---|---|---|
| Alloy CC1 | 531 | 0.0453 | 14 | L | 0.68 | 0.05 | 31.3 |
| Alloy CC1 | 531 | 0.0453 | 14 | LT | 0.70 | | |
| Alloy CC1 | 531 | 0.0453 | 14 | 45 | 0.74 | | |
| Alloy CC1 | 531 | 0.0453 | 30 | L | 0.69 | 0.03 | —* |
| Alloy CC1 | 531 | 0.0453 | 30 | LT | 0.71 | | |
| Alloy CC1 | 531 | 0.0453 | 30 | 45 | 0.73 | | |
| Alloy CC1 | 471 | 0.0591 | 14 | L | 0.76 | 0.04 | 33.2 |
| Alloy CC1 | 471 | 0.0591 | 14 | LT | 0.75 | | |
| Alloy CC1 | 471 | 0.0591 | 14 | 45 | 0.80 | | |
| Alloy CC1 | 471 | 0.0591 | 30 | L | 0.72 | 0.11 | —* |
| Alloy CC1 | 471 | 0.0591 | 30 | LT | 0.72 | | |
| Alloy CC1 | 471 | 0.0591 | 30 | 45 | 0.83 | | |
| Alloy CC2 | 541 | 0.0453 | 14 | L | 0.67 | 0.08 | 31.9 |
| Alloy CC2 | 541 | 0.0453 | 14 | LT | 0.67 | | |
| Alloy CC2 | 541 | 0.0453 | 14 | 45 | 0.75 | | |
| Alloy CC2 | 511 | 0.0591 | 14 | L | 0.78 | 0.03 | 34.4 |
| Alloy CC2 | 511 | 0.0591 | 14 | LT | 0.74 | | |
| Alloy CC2 | 511 | 0.0591 | 14 | 45 | 0.79 | | |
| Alloy CC2 | 541 | 0.0453 | 30 | L | 0.67 | 0.04 | —* |
| Alloy CC2 | 541 | 0.0453 | 30 | LT | 0.67 | | |
| Alloy CC2 | 541 | 0.0453 | 30 | 45 | 0.71 | | |
| Alloy CC2 | 511 | 0.0591 | 30 | L | 0.72 | 0.00 | —* |
| Alloy CC2 | 511 | 0.0591 | 30 | LT | 0.73 | | |
| Alloy CC2 | 511 | 0.0591 | 30 | 45 | 0.72 | | |

*Data not available at the time of the filing of the patent application.

Upon 30 days of natural aging, various samples of the two 6xxx aluminum alloys were then artificially aged, with some samples being pre-strained (PS) by stretching prior to the artificial aging. Various mechanical properties and the intergranular corrosion resistance of these alloys were then measured, the results of which are shown in Tables 5-6, below.

TABLE 5

Mech. Properties for Artificially Aged Alloys of Example 1

| Mat. | Lot No. | Final Gauge (in.) | Pre-strain (PS) | Art. Aging | TYS (MPa) (LT) | UTS (MPa) (LT) | U. Elong. (%)(LT) | T. Elong. (%)(LT) |
|---|---|---|---|---|---|---|---|---|
| Alloy CC1 | 531 | 0.0453 | 2% | 20 min @ 356° F. | 189 | 263 | 19.9 | 25.7 |
| Alloy CC1 | 471 | 0.0591 | 2% | 20 min @ 356° F. | 193 | 265 | 20.0 | 24.7 |
| Alloy CC2 | 541 | 0.0453 | 2% | 20 min @ 356° F. | 195 | 273 | 19.9 | 25.7 |
| Alloy CC2 | 511 | 0.0591 | 2% | 20 min @ 356° F. | 201 | 277 | 19.7 | 25.0 |
| Alloy CC1 | 531 | 0.0453 | 2% | 20 min @ 383° F. | 245 | 292 | 13.5 | 18.3 |
| Alloy CC1 | 471 | 0.0591 | 2% | 20 min @ 383° F. | 251 | 296 | 12.9 | 17.6 |
| Alloy CC2 | 541 | 0.0453 | 2% | 20 min @ 383° F. | 250 | 302 | 13.8 | 18.8 |
| Alloy CC2 | 511 | 0.0591 | 2% | 20 min @ 383° F. | 255 | 306 | 13.9 | 18.4 |
| Alloy CC1 | 531 | 0.0453 | 0% | 30 min @ 437° F. | 243 | 277 | 8.3 | 12.8 |
| Alloy CC1 | 471 | 0.0591 | 0% | 30 min @ 437° F. | 247 | 282 | 8.3 | 12.4 |
| Alloy CC2 | 541 | 0.0453 | 0% | 30 min @ 437° F. | 249 | 289 | 9.1 | 12.6 |
| Alloy CC2 | 511 | 0.0591 | 0% | 30 min @ 437° F. | 251 | 290 | 8.7 | 12.6 |

TABLE 6

IG Corrosion Resistance Properties for Example 1 Alloys

| Mat. | Lot No. | Final Gauge (in.) | Pre-strain (PS) | Art. Aging | Depth of Attack (microns) |
|---|---|---|---|---|---|
| Alloy CC1 | 531 | 0.0453 | 0% | 45 min @ 383° F. | 182 |
| Alloy CC1 | 471 | 0.0591 | 0% | 45 min @ 383° F. | 192 |
| Alloy CC2 | 541 | 0.0453 | 0% | 45 min @ 383° F. | 230 |
| Alloy CC2 | 511 | 0.0591 | 0% | 45 min @ 383° F. | 225 |

As shown, alloys CC1-CC2 realize an improved combination of strength, formability, and corrosion resistance.

Example 2

Five additional 6xxx aluminum alloys were prepared as per Example 1. The compositions, various processing conditions, and various properties of these alloys are shown in Tables 7-10, below.

TABLE 7

Compositions of Example 2 Alloys (in wt. %)

| Material | Si | Fe | Cu | Mn | Mg | Cr | Zn | Ti |
|---|---|---|---|---|---|---|---|---|
| Alloy CC3 | 1.14 | 0.16 | 0.15 | 0.05 | 0.39 | 0.018 | 0.01 | 0.026 |
| Alloy CC4 | 1.13 | 0.17 | 0.34 | 0.05 | 0.38 | 0.019 | 0.01 | 0.080 |

The balance of the alloys was aluminum and unavoidable impurities.

TABLE 8

Processing Parameters for Example 2 Alloys

| Material | Lot No. | Cast Gauge (in.) | Final Gauge (in.) | 1st Stand Reduction (%) (HR) (inline) | 2nd Stand Reduction (%) (HR) (inline) | Offline Cold Rolling Reduction (%) (CR) |
|---|---|---|---|---|---|---|
| Alloy CC3 | 491 | 0.135 | 0.0591 | 24 | 23 | 26 |
| Alloy CC4 | 571 | 0.14 | 0.0669 | 25 | 14 | 26 |

TABLE 9

Mechanical Properties for Example 2 Alloys

| Material | Lot No. | Final Gauge (in.) | Natural Age (days) | Meas. Direction | TYS (MPa) | UTS (MPa) | U. Elong. (%) | T. Elong. (%) |
|---|---|---|---|---|---|---|---|---|
| Alloy CC3 | 491 | 0.0591 | 30 | L | 142 | 248 | 24.9 | 29.9 |
| Alloy CC3 | 491 | 0.0591 | 30 | LT | 139 | 247 | 24.8 | 30.6 |
| Alloy CC3 | 491 | 0.0591 | 30 | 45 | 139 | 247 | 25.0 | 31.1 |
| Alloy CC4 | 571 | 0.0669 | 30 | L | 152 | 263 | 25.3 | 30.1 |
| Alloy CC4 | 571 | 0.0669 | 30 | LT | 149 | 263 | 24.5 | 30.5 |
| Alloy CC4 | 571 | 0.0669 | 30 | 45 | 148 | 261 | 25.4 | 30.5 |

TABLE 10

Additional Mechanical Properties for Example 2 Alloys

| Material | Lot No. | Final Gauge (in.) | Natural Age (days) | Meas. Direction | R Value | Delta R |
|---|---|---|---|---|---|---|
| Alloy CC3 | 491 | 0.0591 | 30 | L | 0.78 | 0.01 |
| Alloy CC3 | 491 | 0.0591 | 30 | LT | 0.76 | |
| Alloy CC3 | 491 | 0.0591 | 30 | 45 | 0.76 | |
| Alloy CC4 | 571 | 0.0669 | 30 | L | 0.75 | 0.03 |
| Alloy CC4 | 571 | 0.0669 | 30 | LT | 0.77 | |
| Alloy CC4 | 571 | 0.0669 | 30 | 45 | 0.79 | |

Upon 30 days of natural aging, various samples of the five 6xxx aluminum alloys were then artificially aged, with some samples being pre-strained (PS) by stretching prior to the artificial aging. Various mechanical properties and the intergranular corrosion resistance of these alloys were then measured, the results of which are shown in Tables 11-12, below.

TABLE 11

Mech. Properties for Artificially Aged Alloys of Example 2

| Mat. | Lot No. | Final Gauge (in.) | Pre-strain (PS) | Art. Aging | TYS (MPa) (LT) | UTS (MPa) (LT) | U. Elong. (%)(LT) | T. Elong. (%)(LT) |
|---|---|---|---|---|---|---|---|---|
| Alloy CC3 | 491 | 0.0591 | 2% | 20 min @ 356° F. | 197 | 268 | 19.0 | 25.0 |
| Alloy CC4 | 571 | 0.0669 | 2% | 20 min @ 356° F. | 201 | 277 | 19.6 | 25.6 |
| Alloy CC3 | 491 | 0.0591 | 2% | 20 min @ 383° F. | 255 | 299 | 12.8 | 17.8 |
| Alloy CC4 | 571 | 0.0669 | 2% | 20 min @ 383° F. | 263 | 309 | 12.8 | 17.6 |
| Alloy CC3 | 491 | 0.0591 | 0% | 20 min @ 437° F. | 249 | 283 | 8.4 | 12.8 |
| Alloy CC4 | 571 | 0.0669 | 0% | 20 min @ 437° F. | 252 | 292 | 8.8 | 13.4 |

TABLE 12

IG Corrosion Resistance Properties for Example 2 Alloys

| Mat. | Lot No. | Final Gauge (in.) | Pre-strain (PS) | Art. Aging | Depth of Attack (microns) |
|---|---|---|---|---|---|
| Alloy CC3 | 491 | 0.0591 | 0% | 45 min @ 383° F. | 227 |
| Alloy CC4 | 571 | 0.0669 | 0% | 45 min @ 383° F. | 230 |

As shown, alloy CC3-CC4 realize an improved combination of strength, formability, and corrosion resistance.

Measurement Standards

The yield strength, tensile strength, and elongation measurements were all conducted in accordance with ASTM E8 and B557.

$FLD_o$ (Engr %) was measured in accordance with ISO 12004-2:2008 standard, wherein the ISO standard is modified such that fractures more than 15% of the punch diameter away from the apex of the dome are counted as valid.

As used herein, "R value" is the plastic strain ratio or the ratio of the true width strain to the true thickness strain as defined in the equation r value=εw/εt. The R value is measured using an extensometer to gather width strain data during a tensile test while measuring longitudinal strain with an extensometer. The true plastic length and width strains are then calculated, and the thickness strain is determined from a constant volume assumption. The R value is then calculated as the slope of the true plastic width strain vs true plastic thickness strain plot obtained from the tensile test. "Delta R" is calculated based on the following equation (1):

$$\text{Delta } R = \text{Absolute Value } [(r_L + r_LT - 2*r_45)/2] \quad (1)$$

where r_L is the R value in the longitudinal direction of the aluminum alloy product, where r_LT is the R value in the long-transverse direction of the aluminum alloy product, and where r_45 is the R value in the 45° direction of the aluminum alloy product.

The intergranular corrosion resistance measurements were all conducted in accordance with ISO standard 11846 (1995) (Method B) (the maximum value of two samples with five sites per sample is reported in the above examples).

Whereas particular embodiments of this invention have been described above for purposes of illustration, it will be evident to those skilled in the art that numerous variations of the details of the present invention may be made without departing from the invention as defined in the appending claims.

What is claimed is:

1. An aluminum alloy consisting essentially of:
1.00-1.45 wt. % Si;
0.32-0.51 wt. % Mg;
wherein a ratio of wt. % Si to wt. % Mg is in the range of from 2.0:1 (Si:Mg) to 4.5:1 (Si:Mg);
0.12-0.44 wt. % Cu;
0.08-0.30 wt. % Fe;
0.02-0.09 wt. % Mn;
0.01-0.06 wt. % Cr;
0.01-0.14 wt. % Ti;
≤0.25 wt. % Zn;
the balance being aluminum and impurities, wherein the aluminum alloy includes ≤0.05 wt. % of any one impurity, and wherein the aluminum alloy includes ≤0.15 in total of all impurities;
wherein the aluminium alloy realizes an improved combination of strength, formability and corrosion resistance;
wherein the strength is at least one of:
(i) a tensile yield strength (LT) of from 100 to 170 MPa in a naturally aged condition; and
(ii) a tensile yield strength (LT) of from 160 to 330 MPa in the artificially aged condition;
wherein the formability is an $FLD_o$ of from 28.0 to 33.0 (Engr %) at a gauge of 1.0 mm when measured in accordance with ISO 12004-2:2008 standard, wherein the ISO standard is modified such that fractures more than 15% of the punch diameter away from the apex of the dome are counted as valid;
wherein the corrosion resistance is a depth of attack of not greater than 350 microns in near peak-aged condition when tested in accordance with ISO standard 11846(1995) (Method B), wherein the near peak-aged condition is within 10% of peak strength.

2. The aluminum alloy of claim 1, having from 1.03 wt. % to 1.40 wt. % Si.

3. The aluminum alloy of claim 1, having from 1.09 wt. % to 1.30 wt. % Si.

4. The aluminum alloy of claim 1, having from 0.32 wt. % to 0.51 wt. % Mg.

5. The aluminum alloy of claim 1, having from 0.35 wt. % to 0.47 wt. % Mg.

6. The aluminum alloy of claim 1, wherein the ratio of wt. % Si to wt. % Mg is in the range of from 2.10:1 to 4.25 (Si:Mg).

7. The aluminum alloy of claim 1, wherein the ratio of wt. % Si to wt. % Mg is in the range of from 2.40:1 to 3.60 (Si:Mg).

8. The aluminum alloy of claim 1, having from 0.12 wt. % to 0.25 wt. % Cu.

9. The aluminum alloy of claim 1, having from 0.15 wt. % to 0.20 wt. % Cu.

10. The aluminum alloy of claim 1, having from 0.27 wt. % to 0.40 wt. % Cu.

11. The aluminum alloy of claim 1, having from 0.06 to 0.14 wt. % Ti.

12. The aluminum alloy of claim 1, having from 0.08 to 0.12 wt. % Ti.

13. The aluminum alloy of claim 1, having not greater than 0.03 wt. % Zn.

* * * * *